United States Patent [19]

Hostettler et al.

[11] 3,944,385

[45] Mar. 16, 1976

[54] PROCESS FOR RENDERING WOOL NON-FELTING

[75] Inventors: Hans Hostettler, Basel; Heinz Abel, Reinach; Rosemarie Topfl, Dornach, all of Switzerland

[73] Assignee: Ciba-Geigy Corporation, Ardsley, N.Y.

[22] Filed: Aug. 6, 1973

[21] Appl. No.: 386,139

[30] Foreign Application Priority Data

Aug. 8, 1972 Switzerland ..... 11704/72

[52] U.S. Cl. ..... 8/128 A; 8/128 R; 260/29.2 EP

[51] Int. Cl.[2] ..... D06M 3/02

[58] Field of Search ..... 8/128 R, 128 A; 260/29.2 EP

[56] References Cited

UNITED STATES PATENTS

| | | | |
|---|---|---|---|
| 2,829,071 | 4/1958 | Schroeder | 117/135.5 |
| 3,649,575 | 3/1972 | Toepfl et al. | 8/128 A |

FOREIGN PATENTS OR APPLICATIONS

| | | | |
|---|---|---|---|
| 991,045 | 5/1965 | United Kingdom | 8/128 |

*Primary Examiner*—Carman J. Seccuro

*Attorney, Agent, or Firm*—Joseph G. Kolodny; Edward McC. Roberts; Prabodh I. Almaula

[57] ABSTRACT

A process for rendering wool non-felting is provided, wherein the wool is treated with aqueous preparations containing a monopersulphine acid salt, an epoxide reaction product, a fatty amine ethylene oxide adduct and a softening agent. Very good non-felting effects without adverse influence on the handle are obtained.

26 Claims, No Drawings

PROCESS FOR RENDERING WOOL NON-FELTING

It is known to provide wool with a non-felting and shrink-resistant finish by means of chemical oxidation, e.g. with chlorine, permanganate, or persulphuric acid, or by the application of polymers. British Pat. No. 716,806 describes the application of monopersulphuric acid with subsequent after treatment by reduction.

In Textilveredlung 5, 846-854 (1970) C.A. Anderson et al describe a process for wool top consisting of a preliminary treatment with the potassium salt of dichloroisocyanuric acid and potassium persulphate followed — after reductive treatment with sodium bisulphite — by a polymer application. The polymers employed are polyamide/epichlorohydrin reaction products.

It is also known to use aqueous solutions or dispersions of compounds containing fatty or resinous epoxide groups, as well as agents that have a chlorinating or oxidising action, for rendering wool non-felting. Fatty epoxides are, for example, expoxidation products of unsaturated fatty acids, while suitable examples of resinous epoxides are glycidic esters of succinic or sebacic acid, glycidic ethers of glycerol, or polymerisation products of methacrylic-glycidic esters or allylglycidic ethers.

Under mild washing conditions the non-felting effects obtainable with these finishing methods are to some extent adequate and do not lead to any adverse effects on the other fibre properties. However, the known application processes do not suffice to obtain a material with a non-felting and shrink-resistant finish and resistant to machine washing, i.e. a material that under machine remains conditions remain very largely non-felting and shrink-resistant. The discovery has now been made that wool provided with a non-felting and shrink-resistant finish in conformity with standards can be obtained by the simultaneous application of acid salts of monopersulphuric acid and special polymer reaction products.

The present invention therefore provides a process for rendering wool non-felting, wherein the wool is treated at 20° to 100°C with aqueous preparations that contain 1) acid alkali, ammonium, or amine salts of monosulphuric acid, 2) reaction products of epoxides, fatty amines, and dicarboxylic acids, the equivalent ratios of epoxide groups to hydrogen bonded to amino nitrogen to carboxylic acid groups being 1:(0.1–1):-(1–0.55), 3) adducts of fatty amines with 12 to 22 carbon atoms and 6 to 30 moles of ethylene oxide which are esterified with at least dibasic oxygen acids, and, optionally, 4) an agent that imparts a soft handle, and is subsequently subjected to a reductive aftertreatment.

As component (1) there are used preferably the acid potassium ($KHSO_5$), sodium ($NaHSO_5$), and ammonium ($NH_4HSO_5$) salts of monopersulphuric acid. It is also possible to use amine salts, for example, alkylamine or alkanolamine salts.

Suitable reaction products of component (2) are water-soluble, or water-dispersible, reaction products of epoxides, fatty amines, and dicarboxylic acids, which are obtained by reacting together, in the presence of an organic solvent, at least (*a*) one epoxide which per molecule contains at least two epoxide groups, (*b*) one fatty amine with 12 to 24 carbon atoms and ($c_1$) one aliphatic, saturated dicarboxylic acid with at least 7 carbon atoms, and, optionally, ($c_2$) one anhydride of an aromatic dicarboxylic acid with at least 8 carbon atoms or of an aliphatic monocarboxylic acid with at least 2 carbon atoms or of a dicarboxylic acid with at least 4 carbon atoms, and, optionally, one or more of the following components: (*d*) an aminoplast precondensate containing alkyl-ether groups, (*e*) an aliphatic diol with 2 to 22 carbon atoms and (*f*) a polyfunctional, preferably difunctional, organic compound which possesses, as functional groups or atoms, mobile halogen, vinyl or ester groups or at most one acid, nitrile, hydroxyl, or epoxide group together with at least one other functional group or one atom of the indicated type, and are thereafter optionally treated, optionally at elevated temperature, with (*g*) ammonia or a water-soluble organic base.

By the optional addition of further ammonia or further water-soluble organic bases the reaction mixture is adjusted to a pH of 5 to 12, or 7.5 to 12, preferably 8 to 10. The pH is determined by diluting a sample of the reaction mixture with water in the ratio of e.g. 1:1.

The epoxides from which the component *a* is obtained are preferably derived from polyhydric phenols or polyphenols, such as resorcinol, or phenol-formaldehyde condensation products of the type of the resols or novolaks. Bisphenols, such as bis-(4-hydroxyphenyl)-methane and, above all, 2,2-bis-(4′-hydroxyphenyl)-propane, are especially preferred as starting compounds for the manufacture of the epoxides.

Compounds to be mentioned especially here are epoxides of 2,2-bis-(4′-hydroxyphenyl)-propane which have an epoxide content of 1.8 to 5.8 epoxy group equivalents/kg, but preferably at least 5 epoxy group equivalents/kg, and which correspond to the formula (1)

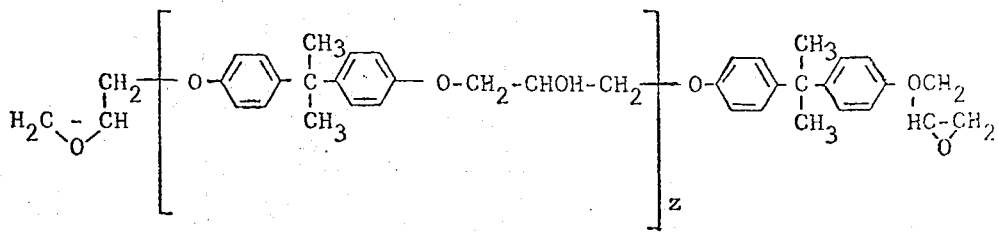

wherein z denotes a mean number from 0 to 0.65. Such epoxides are obtained by reaction of epichlorohydrin with 2,2-bis-(4′-hydroxyphenyl)-propane.

Mono-fatty amines with 12 to 24 carbon atoms have above all proved to be very suitable components b. As a rule these are amines of the formula $$(2)\quad H_3C - (CH_2)_x - NH_2$$

wherein $x$ represents a whole number from 11 to 23, preferably 17 to 21. The amines are therefore, for example, laurylamine, palmitylamine, stearylamine, arachidylamine or behenylamine. Mixtures of such amines, like those obtainable in the form of commercial products, can also be used.

Alkylenedicarboxylic acids with 7 to 14 carbon atoms have above all proved advantageous components *c*. As a rule, these are dicarboxylic acids of the formula $$(3)\quad HOOC-(CH_2)_y-COOH$$

wherein *y* denotes a whole number from 5 to 12, preferably 6 to 10.

Accordingly, possible components *c* are, for example, dicarboxylic acids, such as pimelic, suberic, azelaic or sebacic acid, nonanedicarboxylic acid, decanedicarboxylic acid, undecanedicarboxylic acid or dodecanedicarboxylic acid.

The components *c* can be used single or together with the component $c_2$. As the component $c_2$ there is preferably used an anhydride of a monocyclic or bicyclic aromatic dicarboxylic acid with 8 to 12 carbon atoms or of an aliphatic dicarboxylic acid with 4 to 10 carbon atoms or of a monocarboxylic acid with at least 2 carbon atoms, e.g. acetic acid. Anhydrides of a monocyclic aromatic dicarboxylic acid with 8 to 10 carbon atoms have proved particularly advantageous. Optionally methyl-substituted phthalic anhydride is of particular interest.

Possible components $c_2$ are, accordingly, anhydrides, for example maleic anhydride or phthalic or acetic anhydride.

If the component *d* is used conjointly for the manufacture of the reaction products, its proportion relative to the total of the components *a*, *b*, *c* and *d*, is 10 to 60, especially 20 to 25, per cent by weight.

The aminoplast condensates used as component *d* are completely etherified, or in particular partially etherified, methylol compounds of nitrogen-containing aminoplastforming agents, such as urea, urea derivatives, for example ethyleneurea, propyleneurea or glyoxalmonourein.

Preferably, however, etherified methylolaminotriazines are used, for example, alkyl ethers of highly methylolated melamine, whose alkyl radicals contain 1 to 4 carbon atoms. Possible alkyl radicals include methyl, ethyl, n-propyl, isopropyl, n-butyl and n-hexyl radicals. In addition to such alkyl radicals, yet further radicals, for example polyglycol radicals, can also be present in the molecule. Furthermore, n-butyl ethers of a highly methylolated melamine containing 2 to 3 n-butyl groups in the molecule are preferred. By highly methylolated melamines are meant in this context those with an average of at least 5, appropriately about 5.5, methylol groups.

Where the component *e* is conjointly used for the manufacture of the reaction products, these diols are preferably aliphatic diols with 2 to 6 carbon atoms, and whose carbon chains are optionally interrupted by oxygen atoms. Alkylenediols with 2 to 6 carbon atoms or diethylene glycol or triethylene glycol are here of particular interest. Amongst the alkylenediols with 2 to 6 carbon atoms which are used which particular advantage there may be cited ethylene glycol, 1,4-butanediol, or, above all, 1,6-hexanediol.

The optional polyfunctional, preferably difunctional, component *f* preferably contains, as functional groups or atoms, alkyl-bonded halogen atoms, vinyl or carboxylic acid ester groups, or at most one epoxide, carboxylic acid or hydroxyl group together with another functional group or another atom of the indicated type. In particular, these compounds are difunctional organic compounds which contain, as functional groups or atoms, alkyl-bonded chlorine or bromine atoms, vinyl or carboxylic acid alkyl ester groups or at most one epoxide or carboxylic acid group together with another functional group or another atom of the indicated type.

Particularly suitable difunctional organic compounds are aliphatic. These are, for example, epihalogenohydrines, such as epibromohydrin or above all epichlorohydrin.

Other possible difunctional compounds are, for example, glycerol-dichlorohydrin, acrylic acid, methylolacrylamide and acrylonitrile.

The component *g* is appropriately an aliphatic tertiary monoamine, ammonia or an amine containing at least two amino groups and exclusively basic nitrogen atoms, wherein the amino groups possess at least one nitrogen-bonded hydrogen atom.

Preferred tertiary amines are trialkylamines with 3 to 12 carbon atoms, for example triethylamine, tri-n-propylamine or tri-n-butylamine.

The diamines to be used as component *g* can be aliphatic or cycloaliphatic and preferably possess at least one primary amino group and a second amino group, wherein at least one hydrogen atom is bonded to nitrogen. Furthermore, just ammonia can also be used as component *g*. However, di-primary aliphatic or cycloaliphatic amines are preferentially used as the component *g*.

Suitable aliphatic amines are here above all polyamines, such as diethylenetriamine, triethylenetetramine or tetraethylenepentamine, that is to say amines of the formula $$(4)\quad H_2N-(CH_2-CH_2-NH)_n-CH_2-CH_2-NH_2$$

wherein *n* is 1, 2 or 3.

In the case of amine mixtures, a non-integral average value can also be assumed, for example between 1 and 2.

Suitable cycloaliphatic amines are above all diprimary, cycloaliphatic diamines, which apart from the two amine nitrogen atoms only contain carbon and hydrogen, and which possess a saturated 5-membered to 6-membered carbocyclic ring, a $H_2N-$ group bonded to a ring carbon atom and a $H_2N-CH_2-$ group bonded to another ring carbon atom.

As examples of such amines, 3,5,5-trimethyl-1-amino-3-aminomethyl-cyclohexane or 1-amino-2-amino-methylcyclopentane may be mentioned.

The manufacture of the reaction products can be carried out according to methods which are in themselves known, wherein the components can be reacted with one another in varying sequence. Appropriately, components *a* and *b*, or *a*, *b* and $c_1$ are first reacted with one another. The reaction of the component $c_1$ with the already reacted components *a* and *b* can also take place simultaneously with component *e*. The reaction with the components *d* and/or *f* is as a rule only carried out at the end, that is to say before the reaction with the component *g*.

On the one hand, it is therefore possible initially to react the components *a*, *b*, and $c_1$, and optionally $c_2$, simultaneously with one another, and subsequently optionally to react the product with the components *d*, *e* and *f*. In this modification of the process the components *a*, *b* and *c* are appropriately reacted with one another at temperatures of 80° to 120°C, preferably 100°C, and the proportions are advantageously so chosen that for an epoxide group equivalent of 1, the equivalent ratio of hydrogen bonded to amine nitrogen to carboxylic acid groups is 0.1 : 1 to 1 : 0.55.

On the other hand, it is also possible first to react only the components a and b with one another, and subsequently to react the products with the component $c_1$ and, optionally, in a third stage with the components *d*, *e* or (*f*). The manufacture of the reaction products from (*a*) and (*b*) is, according to this 2nd modification, also appropriately carried out at temperatures of 80° to 120°C, preferably at about 100°C. The reaction in the second stage with the component $c_1$ appropriately takes place at 80° to 110°C, preferably at about 100°C, and the proportions are advantageously so chosen that for an epoxide group equivalent of 1, the equivalent ratio of hydrogen bonded to amine nitrogen to carboxylic acid groups is 0.1 : 1 to 1 : 0.55.

The ratio of epoxide *a* to fatty amine *b* and acid $c_1$ or anhydride $c_2$ is so chosen, according to the invention, that a less than equivalent amount of epoxide is used, so that there is fewer than one epoxide group per sum of the amino and acid groups. The reaction products thus contain carboxyl end groups, but no epoxide groups.

The reaction product containing carboxylic acid groups as a rule has an acid number of 20 to 80, preferably 35 to 60.

The reaction with the component *d* is as a rule carried out at temperatures of 60° to 105°C, preferably at abour 100°C. In most cases, this reaction takes place in the presence of a small amount of an organic solvent, for example, n-butanol.

The reaction with the component *e* takes place, as already mentioned, simultaneously with that of component $c_1$.

The reaction with the component *f* takes place before the treatment with component *g* at temperatures of about 60° to 120°C.

The treatment with the component *g* can take place at room temperature or elevated temperature, so that either merely a neutralisation accompanied by salt formation occurs, or, provided tertiary amines are not used, a true reaction takes place. In both cases, however, polyaddition products which are soluble or dispersible in water are produced by ensuring that, not later than on completion of the reaction, if necessary by adding a base, a sample of the reaction mixture diluted with water shall have a pH value of 5 to 12 or 7.5 to 12, preferably of 8 to 10. For this purpose there are used e.g. inorganic or organic bases, advantageously readily volatile bases such as ammonia.

Furthermore it is advantageous to use temperatures of at most 80°C, for example 60° to 70°C, in a reaction with *g*. When using ammonia or a tertiary amine as the component *g*, the reaction is appropriately carried out at room temperature. The solutions or dispersions thus obtained, treated with a base if appropriate, and preferably adjusted by means of an organic solvent or by means of water to a content of 10 to 40% of reaction product, are distinguished by high stability.

Suitable organic solvents in the presence of which the reaction products are manufactured are, above all, water-soluble organic solvents, and, in particular, advantageously those which are miscible with water to an unlimited extent. Dioxan isopropanol, ethanol and methanol, ethylene glycol n-butyl ether (=n-butylglycol), diethylene glycol monobutyl ether, and dimethyl formamide may be cited as examples.

Moreover it is also possible to carry out the reaction in the presence of water-insoluble organic solvents, for example in hydrocarbons, such as petroleum distillate, benzene toluene and xylene, or in halogenated hydrocarbons, such as methylene chloride, methylene bromide, chloroform, carbon tetrachloride, ethylene chloride, ethylene bromide, s-tetrachloroethane and above all trichloroethylene.

The esterified fatty amine-ethylene oxide adducts used as component 3 are derived from fatty amines which contain aliphatic hydrocarbon radicals with 12 to 22 carbon atoms, preferably 16 to 18 carbon atoms. The aliphatic hydrocarbon radicals can be saturated or unsaturated, branched or, preferably, unbranched.

Possible basic materials are unitary higher-molecular alkylamines or mixtures such as are obtained on converting natural fatty acid mixtures, for example tallow fatty acid, into the corresponding amines. As amines, there may severally be mentioned dodecylamine, hexadecylamine, stearylamine, octadecylamine, arachidylamine $[H_3C—(CH_2)_{19}—NH_2]$, behenylamine $[H_3C—(CH_2)_{21}—NH_2]$ and octadecenylamine.

The reaction of these amines with ethylene oxide yields, in a known manner, polyglycol compounds of the formula $$R—N\begin{matrix}(CH_2CH_2O)_m—H \\ (CH_2CH_2O)_n—H\end{matrix},$$

wherein R denotes an aliphatic, preferably unbranched, hydrocarbon radical with 12 to 22 carbon atoms and the sum $(m + n)$ denotes a whole number having a value of 6 to 30, preferably 7 to 16.

The esterification is appropriately carried out with functional derivatives of at least dibasic oxygencontaining acids under such conditions that at least one acid ester group is introduced, preferably in the form of an alkali salt, ammonium salt or amine salt. As polybasic organic acids for the formation of the acid esters it is possible to use organic polycarboxylic acids or carboxylic acid-sulphonic acids, for example maleic acid or succino-sulphonic acid, or polybasic inorganic oxygencontaining acids, such as phosphoric acid or preferably sulphuric acid, or functional derivatives of these acids, such as anhydrides, halides or amides. The acid sulphuric acid esters are advantageously directly manufactured in the form of their ammonium salts by heating the starting substances with amidosulphonic acid in the presence of urea. Thereafter, dilute aqueous solutions of the esters are appropriately produced.

Suitable reducing agents besides the alkali and alkaline earth sulphides and hydrogensulphides are also hydroxylamines, e.g. hydroxyamine sulphate or thiosulphates and, above all, the salts of sulphurous acid, for example the sulphites and hydrogen sulphites of lithium, sodium, potassium, magnesium, calcium, strontium, barium, aluminium, zinc, or manganese, or the ammonium salts. Preferred are the sodium and potassium sluphites and hydrogen sulphites.

The combination of the components (1) to (3) and, optionally, (4), can be used for finishing textiles, in particular for the non-felting of wool or fibre blends that contain wool, e.g. blends of wool with synthetic polyamide, polyester, polyacrylonitrile, or cellulose fibre materials, whereby the wool is impregnated with an aqueous liquor to which have been added the components and, if desired, small amounts of further additives such as wetting and dispersing agents and salts, and then dried. The process is advantageously so carried out that the wool is wetted out, then to the same bath are added first the acid salts of monopersulphuric acid and then components (2) and (3), and the wool is then treated at temperatures of 20° to 100°C and a pH of 2 to 5, preferably 3 to 5. Suitable liquor ratios are between 1:10 and 1:70.

The reductive aftertreatment can be carried out subsequently in the same bath, then the finished material is centrifuged and dried, e.g. at 40° to 120°C. The amount of component (1), based on the weight of the wool, is about 1 to 5%.

The amount of component (2) (not taking into account solvent and water), based on the weight of the wool, is advantageously 0.5% to 5%, preferably 1.2% to 4%. The amount of amine-ethyleneoxy adduct is 0.01% to 2%, based on the weight of the wool. As already mentioned, the process is carried out at temperatures of 20° to 100°C, preferably 35° to 100°C, and in most cases the time required for an extensive to an almost complete fixing of the polyaddition product is between 5 and 60 minutes.

In addition to the preparation of the polyaddition product and the esterified amine-ethyleneoxy adduct the liquor used for the non-felting also contains the necessary amount of acid or base for regulating the pH, e.g. sulphuric acid, hydrochloric acid, oxalic acid or, in particular, acetic acid or ammonia and sodium bicarbonate. But is also possible to use still other salts, for example sodium sulphite or sodium thiosulphate. The liquors can also contain in addition other customary additives, for example agents that impart a soft handle, or bleaching agents, e.g. hydrogen peroxide.

Examples of suitable agents for imparting a soft handle as component (4) are oil, fat, and wax emulsions, fatty acid condensation products or also polyethylene, polyethylene glycol, siloxane, and silicone oil emulsions. If necessary or desired it is also possible to use mixtures of the cited agents for imparting a soft handle.

Examples of suitable fatty acid condensation products are: fatty acid methylolamides, optionally reacted with thioglycolic acid or aminoplast preceondensates, fatty acid polyalkylenepolyamine reaction products, optionally reacted with ethylene oxide or other epoxides or epoxide reaction products. The fatty acids contain 12 to 24, preferably 16 to 22, carbon atoms, for example palmitic, stearic, arachidic, or behenic acid.

The agents for imparting a soft handle are added preferably in emulsified form to the liquors containing the non-felting agents, but they can also be added to the exhausted, or very largely exhausted, liquors and applied in the form of an aftertreatment. The emulsions of the agents for imparting a soft handle contain abour 10 to 30% by weight of active substance. The application amount for a 20% emulsion is about 0.5 to 4% by weight, based on the weight of the wool.

Particularly suitable are, for example, mixtures of agents for imparting a soft handle that contain e.g. 50 to 80 parts by weight of a polyethylene (contains partially oxidised carboxyl groups) and 20 to 50 parts by weight of a condensation product of dimerised unsaturated fatty acids and polyalkylene polyamines, for example diethylene triamine and triethylene tetramine, or 50 to 80 parts by weight of paraffin (melting point range 50° to 70°C) and 10 to 20 parts by weight of the cited condensation product. The dimeric unsaturated fatty acids can be derived from e.g. unsaturated fatty acids with 16 to 22 carbon atoms; preferably linoleic, linolenic, eleostearic, or clupanodenic acid.

If desired it is also possible to admix in addition small amounts of silicone oil. In addition to the improved soft handle of the substrates the agents for imparting a soft handle also achieve an additional improvement in the non-felting effect.

The material to be finished in accordance with the process of the present invention can be used in any state of processing, e.g. in the form of top, yarn, cheese, woven or knotted fabrics. Also it can be dyed or undyed, in which case the dyed material suffers no change in shade, but rather are the dyestuffs additionally fixed.

Very good non-felting effects on woollen materials are obtained by means of the process according to the invention without this leading to any adverse influence on the handle. The non-felting effect attained is substantially better than the effects of the individual components (persulphuric acid compound and polymer) and also better than the sum of the effects of the individual components. The process according to the invention provides material that can be machine washed, which constitutes a significant advance in the art in the field of providing wool with a non-felting finish.

When using the preparations in combination with an aminoplast on textiles, particularly on cotton, a wash-resistant soil realease effect is obtained. It is also possible to impart a non-iron finish to the textiles with the preparations.

Furthermore, finishes with the present reaction products also improve the mechanical properties of the treated material, e.g. ultimate tensile strength, elongation at break, abrasion resistance, tendency to pilling. The following Examples illustrate the invention, the parts and percentages being by weight. The testing of the non-felting effect is in accordance with IWS Specification 72 and is performed as follows: the finished material is treated in an aqueous liquor (liquor ratio 1:15) at 40°C and a pH of 7 (phosphate buffered) for 180 minutes. Maximum permissible shrinkage: 10%. The test corresponds to about 100 machine washes in a normal programm up to 60°C.

EXAMPLE 1

98 G of an epoxide formed from 2,2-bis-(4'-hydroxyphenyl)-propane and epichlorohydrin (0.5 epoxide group equivalent) together with 54.2 g of a mixture of 1-aminoeicosane and 1-amino-docosane (0.35 amino group equivalent) and 47 g of azelaic acid (0.5 acid group equivalent) are stirred for 2 hours at 100°C internal temperature in a nitrogen atmosphere. An 80% strength solution of 54.2 g of hexamethylolmelamine dibutyl and tributyl ether (that is to say a mixture of di- and tri-n-butyl ethers of a highly methylolated melamine) in n-butanol is then added and the mixture is again stirred for 1 hour at 100°C. Dilution with 240 g of ethylene glycol monobutyl ether yields a 50% strength product of medium viscosity, having an acid number of 46.4.

121 G of the 50% strength product described (0.05 acid group equivalent) together with 12.2 g of triethylenetetramine (0.5 amino group equivalent) are warmed for 1 hour at 60°C internal temperature. After dilution with 225 g of ethylene glycol monobutyl ether a clear solution is obtained. The preparation can be diluted with water and has a pH value of 9.7.

EXAMPLE 2

98 G (0.5 epoxide group equivalent) of the epoxide described in Example 1 together with 54.2 g (0.35 amino group equivalent) of a mixture of 1-amino-eicosane and 1-amino-docosane and 60.6 g (0.6 acid group equivalent) of sebacic acid are stirred for 2 hours at 100°C internal temperature in a nitrogen atmosphere. An 80% strength solution of 54.2 g of hexamethylolmelamine di- and tri-n-butyl ether in n-butanol is then added and the mixture is again stirred for 1 hour at 100°C. Dilution with 253 g of ethylene glycol monobutyl ether yields a 50% strength product of medium viscosity, having an acid number of 58.4.

192 G of the 50% strength product described (0.1 acid group equivalent) together with 24.4 g of triethylenetetramine (1.0 amino group equivalent) are stirred for 1 hour at 60°C internal temperature.

After dilution with 371.6 g of ethylene glycol monobutyl ether and adding 9 g of 24% strength ammonia, a clear solution which is miscible with water to an unlimited extent obtained. The pH value is 9.8.

EXAMPLE 3

98 G (0.5 epoxide group equivalent) of the epoxide described in Example 1 together with 54.2 g (0.35 amino group equivalent) of a mixture of 1-aminoeicosane and 1-aminodocosane and 50.5 g (0.5 acid group equivalent) of sebacic acid are stirred for 5 hours at 100°C internal temperature in a nitrogen atmosphere. An 80% strength solution of 54.2 g of hexamethylolmelamine di- and tri-butyl ether in butanol is then added and the mixture is again stirred for 1 hour at 100°C. Dilution with 243 g of ethylene glycol monobutyl ether yields a 50% strength product of medium viscosity, having an acid number of 45.

124.2 G of the 50% strength product described (0.05 acid group equivalent) together with 12.2 g of triethylenetetramine (0.5 amino group equivalent) are stirred for 1 hour at 60°C internal temperature. After dilution with 226 g of ethylene glycol monobutyl ether a clear solution which is infinitely miscible with water is obtained. The pH value is 9.5.

EXAMPLE 4

98 G (0.5 epoxide group equivalent) of the epoxide described in Example 1 together with 54.2 g (0.35 amino group equivalent) of a mixture of 1-aminoeicosane and 1-aminodocosane and 45.4 g (0.45 acid group equivalent) of sebacic acid are stirred for 2 hours at 100°C internal temperature in a nitrogen atmosphere. An 80% strength solution of 54.2 g of hexamethylolmelamine di- and tri-butyl ether in butanol is then added and the mixture is again stirred for 1 hour at 100°C. Dilution with 238 g of ethylene glycol monobutyl ether yields a 50% strength product of medium viscosity having an acid number of 41.3.

135.5 G of the 50% strength product described (0.05 acid group equivalent) together with 12.2 g of triethylenetetramine (0.5 amino group equivalent) are stirred for 1 hour at 60°C internal temperature. After dilution with 242 g of ethylene glycol monobutyl ether and adding 6.4 g of 24% strength ammonia, a clear solution which is miscible with water to an unlimited extent is obtained. The pH value is 9.9.

EXAMPLE 5

98 G (0.5 epoxide group equivalent) of the epoxide described in Example 1 together with 54.2 g (0.175 amino group equivalent) of a mixture of 1-aminoeicosane and 1-aminodocosane and 50.5 g (0.5 acid group equivalent) of sebacic acid are stirred for 2 hours at 100°C internal temperature in a nitrogen atmosphere. After dilution with 202.7 g of ethylene glycol monobutyl ether a 50% strength product of medium viscosity having an acid number of 57.8 is obtained.

145.5 g of the 50% strength product described (0.075 acid group equivalent) together with 18.3 g of triathylenetetramine (0.75 amino group equivalent) are stirred for 1 hour at 60°C internal temperature. After dilution with 281 g of ethylene glycol monobutyl ether a clear solution which is miscible with water to an to an unlimited extent is obtained. The pH value is 10.1.

EXAMPLE 6

98 G (0.5 epoxide group equivalent) of the epoxide described in Example 1 together with 31 g of a mixture of 1-amino-eicosane and 1-amino-docosane (0.2 amino group equivalent) and 50 g of n-butylglycol are stirred for 3 hours at 100°C. 40.1 g of pimelic acid (0.5 acid group equivalent) are then added and the mixture is again stirred for 3 hours at 100°C internal temperature. It is then diluted with 119 g of n-butyl glycol and further stirred until cold. A clear product of medium viscosity having an acid number of 70 is obtained.

150 g of the 50% strength product described are treated with 25 g of triethylamine and 12 g of n-butylglycol. A clear solution of 40% solids content is obtained. A sample of this solution is diluted with deionised water (1:20); the pH value of this sample is 10.5.

An analogous procedure is followed with the products which are manufactured according to Example 7 to 24,26 and 27 and 29 to 35 below.

EXAMPLE 7

98 G (0.5 epoxide group equivalent) of the epoxide according to Example 1 together with 31 g (0.2 amino group equivalent) of a mixture of 1-amino-eicosane and 1-aminodocosane and 50 g of butyl glycol are stirred for 3 hours at 100°C internal temperature. 58.6 G of dodecanedicarboxylic acid (0.5 acid group equivalent) are then added and the mixture is again stirred for 3 hours at 100°C internal temperature. After dilution with 137 g of n-butylglycol a clear product of medium viscosity having an acid number of 65.5 is obtained.

EXAMPLE 8

98 G (0.5 epoxide group equivalent) of the epoxide according to Example 1 together with 31 g (0.2 amino group equivalent) of a mixture of 1-amino-eicosane and 1-aminodocosane and 50 g of butyl glycol are stirred for 3 hours at 100°C internal temperature. 14.75 G of 1,6-hexanediol (0.25 hydroxyl group equivalent) and 50.5 g of sebacic acid (0.5 acid group equivalent) are then added and the mixture is again stirred for 3 hours at 100°C internal temperature. It is then diluted with 144 g of n-butylglycol and further stirred until cold. A clear product of medium viscosity having an acid number of 63 is obtained.

EXAMPLE 9

98 G (0.5 epoxide group equivalent) of the epoxide according to Example 1 together with 54.2 g (0.175 amino group equivalent) of a mixture of 1-amino-eicosane and 1-aminodocosane and 50 g of n-butylglycol are stirred for 5 hours at 100°C internal temperature. 60.6 G of sebacic acid (0.6 acid group equivalent) are then added and the mixture is stirred for a further 5 hours at 100°C internal temperature. After addition of 16.2 g of epichlorohydrin (0.175 mol) the whole is again stirred for 5 hours at 100°C internal temperature. It is then diluted with 179 g of n-butylglycol and further stirred until cold. A clear product of medium viscosity having an acid number of 64 is obtained.

EXAMPLE 10

98 G (0.5 epoxide group equivalent) of the epoxide according to Example 1 together with 31 g (0.2 amino group equivalent) of a mixture of 1-amino-eicosane and 1-aminodocosane and 50 g of butylglycol are stirred for 5 hours at 100°C internal temperature. 50.5 G of sebacic acid (0.5 acid group equivalent) and 7.4 g of phthalic anhydride (0.1 acid group equivalent) are then added and the mixture is again stirred for 5 hours at 100°C internal temperature. 9.25 G of epichlorohydrin (0.1 mol) are now added and the whole is stirred for a further 5 hours at 100°C. It is then diluted with 146 g og n-butylglycol and further stirred until cold. A clear mobile product of acid number 67 is obtained.

EXAMPLE 11

98 G (0.5 epoxide group equivalent) of an epoxide according to Example 1 together with 31 g (0.2 amino group equivalent) of a mixture of 1-amino-eicosane and 1-aminodocosane and 50 g of butylglycol are storred for 3 hours at 100°C internal temperature. 17.7 G of 1,6-hexanediol (0.3 hydroxyl group equivalent) and 50.5 g of sebacic acid (0.5 acid group equivalent) are then added and the mixture is again stirred for 3 hours at 100°C internal temperature. After adding 4.6 G of epichlorohydrin (0.05 mol) the whole is then stirred for a further 3 hours at 100°C internal temperature and is subsequently diluted with 151.9 G of n-butylglycol and further stirred until cold. A clear mobile product of acid number 43.6 is obtained.

EXAMPLE 12

98 G (0.5 epoxide group equivalent) of the epoxide described in Example 1 together with 31 g of a mixture of 1-amino-eicosane and 1-amino-docosane (0.2 amino group equivalent) and 50 g of n-butylglycol are stirred for 3 hours at 100°C internal temperature. 50.5 G of sebacic acid (0.5 acid group equivalent) and 9.8 G of maleic anhydride (0.2 acid group equivalent) are then added and the mixture is again stirred for 3 hours at 100°C internal temperature. Thereafter 9.25 g of epichlorohydrin (0.1 mol) are also addded and the whole is again stirred for 3 hours at 100°C internal temperature. After adding 148.5 G of n-butylglycol it is stirred until cold. A clear product of medium viscosity and of acid number 60.3 is obtained.

EXAMPLE 13

98 g (0.5 epoxide group equivalent) of the epoxide described in Example 1 together with 31 G of a mixture of 1-amino-eicosane and 1-amino-docosane (0.2 amino group equivalent) and 50 G of n-butylglycol are stirred for 3 hours at 100°C internal temperature. 14.75 G of 1,6-hexanediol (0.25 hydroxyl group equivalent) and 50.5 g of sebacic acid (0.5 acid group equivalent) are then added and the mixture is again stirred for 3 hours at 100°C internal temperature. After cooling to 60°C internal temperature, 6.5 G of glycerol dichlorohydrin (0.05 mol) are added and the batch is stirred for 3 hours at 60°C internal temperature. 150.7 G of n-butylglycol are then added and the mixture is further stirred until cold. A clear product of medium viscosity and of acid number 61.5 is obtained.

EXAMPLE 14

98 G (0.5 epoxide group equivalent) of the epoxide described in Example 1 together with 31 g of a mixture of 1-amino-eicosane and 1-amino-docosane (0.2 amino group equivalent) and 50 g of n-butylglycol are stirred for 3 hours at 100°C internal temperature. 44.5 G of polypropylene glycol (0.1 mol) and 50.5 G of sebacic acid (0.5 acid group equivalent) are then added and the mixture is again stirred for 3 hours at 100°C internal temperature. After adding 9.25 G of epichlorohydrin (0.1 mol) the batch is stirred for a further 3 hours at 100°C internal temperature and 183.25 g of n-butylglycol are then added. A clear product of medium viscosity and of acid number 31 is obtained.

EXAMPLE 15

98 G (0.5 epoxide group equivalent) of the epoxide described in Example 1 together with 18.6 g of laurylamine (0.2 amino group equivalent) and 45 g of n-butylglycol are stirred for 3 hours at 100°C internal temperature. 50.5 g of sebacic acid (0.5 acid group equivalent) are then added and the mixture is again stirred for 3 hours at 100°C internal temperature. Thereafter 5.3 g of acrylonitrile (0.1 mol) are added and the batch is stirred for a further 3 hours at 100°C internal temperature. After adding 127 g of n-butylglycol it is further stirred until cold and a clear product of medium viscosity and of acid number 65.8 is obtained.

EXAMPLE 16

98 G (0.5 epoxide group equivalent) of the epoxide described in Example 1 together with 27 g of stearylamine (0.1 amino group equivalent) and 50 g of n-butylglycol are stirred for 3 hours at 100°C internal temperature. 50.5 G of sebacic acid (0.5 acid group equivalent) are then added and the mixture is again stirred for 3 hours at 100°C internal temperature. Thereafter, 10.2 g of acetic anhydride (0.1 mol) are added and the whole is stirred for a further 3 hours at 100°C internal temperature. After adding 135 g of n-butylglycol it is further stirred until cold and a clear product of medium viscosity and of acid number 91.7 is obtained.

EXAMPLE 17

98 G (0.5 epoxide group equivalent) of the epoxide described in Example 1 together with 54.2 g of a mixture of 1-amino-eicosane and 1-amino-docosane (0.35 amino group equivalent) and 47 g of azelaic acid (0.5 acid group equivalent) are warmed for 2 hours to 100°C internal temperature. An 80% strength solution of 54.2 g of hexamethylolmelamine dibutyl and tributyl ether in n-butanol is then added and the mixture is again stirred for 1 hour at 100°C internal temperature. Dilution with 240 g of n-butylglycol yields a clear product of medium viscosity and of acid number 46.4.

EXAMPLE 18

98 G (0.5 epoxide group equivalent) of the epoxide described in Example 1 together with 31 g of a mixture of 1-amino-eicosane and 1-amino-docosane (0.1 amino group equivalent) and 50 g of n-butylglycol are stirred for 2 hours at 100°C internal temperature. 50.5 G of sebacic acid (0.5 acid group equivalent) are then added and the mixture is again stirred for 2 hours at 100°C internal temperature. After adding 12.4 g of ethylene glycol (0.4 hydroxyl group equivalent) the batch is stirred for a further 2 hours at 100°C internal temperature. An 80% strength solution of 54.2 g of hexamethylolmelamine dibutyl and tributyl ether in n-butanol is then added and the mixture is stirred for 2 hours at 100°C internal temperature. After dilution with 182 g of n-butylglycol, a clear product of medium viscosity and of acid number 42.9 is obtained.

EXAMPLE 19

98 G (0.5 epoxide group equivalent) of the epoxide described in Example 1 together with 46.5 g of a mixture of 1-amino-eicosane and 1-amino-docosane (0.3 amino group equivalent) and 50 g of n-butylglycol are warmed for 3 hours at 100°C internal temperature. 60.6 G of sebacic acid (0.6 acid group equivalent) are then added and the mixture is stirred for 3 hours at 100°C internal temperature. After adding 13.9 g of epichlorohydrin (0.15 mol) the batch is again stirred for 3 hours at 100°C internal temperature. After dilution with 225 g of n-butylglycol, the reaction product is cooled to 70°C internal temperature and an 80% strength solution of 93.5 g of hexamethylolmelamine dibutyl and tributyl ether is added and the mixture is again stirred for 30 minutes at 70°C internal temperature.

It is thereafter cooled to room temperature.

EXAMPLE 20

98 G (0.5 epoxide group equivalent) of the epoxide described in Example 1 together with 31 g of a mixture of 1-amino-eicosane and 1-amino-docosane (0.2 amino group equivalent) and 50 g of n-butylglycol are stirred for 3 hours at 100°C internal temperature. Thereafter 17.7 g of 1,6-hexanediol (0.3 hydroxyl group equivalent) and 50.5 g of sebacic acid (0.5 acid group equivalent) are added and the mixture is again stirred for 3 hours at 100°C internal temperature. After adding 4.6 g epichlorohydrin (0.05 mol) the whole is stirred for a further 3 hours at 100°C internal temeprature. After dilution with 207.9 g of n-butylglycol the product is cooled to 70°C internal temperature and an 80% strength solution of 93.5 g of hexamethylolmelamine dibutyl and tributyl ether in n-butanol is added, and the mixture is again stirred for 30 minutes at 70°C internal temperature. Thereafter it is cooled to room temperature.

EXAMPLE 21

98 G (0.5 epoxide group equivalent) of the epoxide described in Example 1 together with 31 g (0.2 amino group equivalent) of a mixture of 1-amino-eicosane and 1-amino-docosane and 50 g of n-butylglycol are stirred for 3 hours at 100°C internal temperature. Thereafter 9.3 g of 1,2-propylene glycol (0.25 hydroxyl group equivalent), 40.4 g of sebacic acid (0.4 acid group equivalent) and 7.4 g of phthalic anhydride (0.1 acid group equivalent) are added and the mixture is again stirred for 3 hours at 100°C internal temperature. It is subsequently diluted with 136 g of n-butylglycol and further stirred until cold. A clear product of medium viscosity and of acid number 57 is obtained.

EXAMPLE 22

98 G (0.5 epoxide group equivalent) of the epoxide described in Example 1 together with 31 g (0.2 amino group equivalent) of a mixture of 1-aminoeicosane and 1-amino-docosane and 50 g of n-butylglycol are stirred for 3 hours at 100°C internal temperature. 11.25 g of 1,4-butanediol (0.25 hydroxyl group equivalent), 50.5 g of sebacic acid (0.5 acid group equivalent) and 7.4 g of phthalic anhydride (0.1 acid group equivalent) are then added and the mixture is stirred for a further 3 hours at 100°C internal temperature. After adding 9.25 g of epichlorohydrin (0.1 mol) the whole is again stirred for 3 hours at 100°C internal temperature. After dilution with 157 g of n-butylglycol it is further stirred until cold. A clear product of medium viscosity and of acid number 43.6 is obtained.

EXAMPLE 23

98 G (0.5 epoxide group equivalent) of the epoxide described in Example 1 together with 31 g (0.2 amino group equivalent) of a mixture of 1-amino-eicosane and 1-amino-docosane and 50 g of n-butylglycol are stirred for 3 hours at 100°C internal temperature. Thereafter 22.5 g (0.3 hydroxyl group equivalent) of triethylene glycol and 50.5 g (0.5 acid group equivalent) of sebacic acid are added and the mixture is again stirred for 3 hours at 100°C internal temperature. After adding 4.6 g of epichlorohydrin (0.05 mol) the whole is again stirred for 3 hours at 100°C internal temperature. After dilution with 156.6 g of n-butylglycol it is further stirred until cold. A clear product of medium viscosity and of acid number 48 is obtained.

EXAMPLE 24

98 G (0.5 epoxide group equivalent) of the epoxide described in Example 1 together with 31 g (0.2 amino group equivalent) of a mixture of 1-amino-eicosane and 1-amino-docosane and 50 g of n-butylglycol are stirred for 3 hours at 100°C internal temperature. 15.9 G of diethylene glycol (0.3 hydroxyl group equivalent) and 50.5 g of sebacic acid (0.5 acid group equivalent) are then added and the mixture is again stirred for 3 hours at 100°C internal temperature. After adding 4.6 g of epichlorohydrin (0.05 mol) the whole is stirred for a further 3 hours at 100°C internal temperature. After adding 150 g of n-butylglycol it is further stirred until cold. A clear product of medium viscosity and of acid number 47.8 is obtained.

EXAMPLE 25

98 G (0.5 epoxide group equivalent) of the epoxide described in Example 1 together with 31 g (0.1 amino group equivalent) of a mixture of 1-amino-eicosane and 1-amino-docosane and 50 g of n-butylglycol are stirred for 3 hours at 100°C internal temperature. 15.6 G of neopentyl glycol (0.3 hydroxyl group equivalent) and 50.5 g of sebacic acid (0.5 acid group equivalent) are then added and the mixture is again stirred for 3 hours at 100°C internal temperature. After adding 4.6 g of epichlorohydrin (0.05 mol) the batch is again stirred for 3 hours at 100°C internal temperature.

After dilution with 149.7 g of n-butylglycol it is further stirred until cold. A clear product of medium viscosity and of acid number 47.5 is obtained.

a. 177 G of the 50% strength product described (0.075 acid equivalent) together with 31 g of diethylenetriamine (1.5 amino group equivalent) and 12.5 g of butylglycol are stirred for 1 hour at 60°C internal temperature.

After adding 20 g of 24% strength ammonia and 194 g of butylglycol a clear mobile solution of pH value 10.3 is obtained.

b. 177 G of the 50% strength product described (0.075 acid equivalent) together with 40.6 G of tetraethylenepentamine (1.5 amino group equivalent) and 3 g of butylglycol are stirred for 1 hour at 60°C internal temperature.

After adding 50 g of 24% strength ammonia and 163 g of butylglycol a mobile solution of pH 10.4 is obtained.

c. 236 G of the 50% strength product described (0.1 acid equivalent) together with 85 g of isophoronediamine (1-amino-3-aminomethyl-3,5,5-trimethyl-cyclohexane) (1-amino group equivalent), 20 g of 24% strength ammonia and 248 g of butylglycol are stirred at room temperature. A mobile solution of pH value 10.8 is obtained.

d. 200 G of the 50% strength product described are mixed with 21 g of 24% strength ammonia and after thorough stirring are diluted with 279 g of butylglycol. A mobile solution of pH value 8.5 is obtained.

e. 177 G of the 50% strength product described are mixed with 44 g of triethanolamine. A product of medium viscosity and of pH value 8.5 is obtained.

f. 234 G of the 50% strength product described are mixed with 71 g of tri-n-propylamine, 20 g of 24% strength ammonia and 159 g of butylglycol. A mobile solution of pH value 10.0 is obtained.

EXAMPLE 26

78 G of an epoxide of the following formula

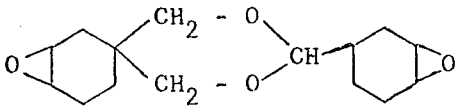

(0.5 epoxide equivalent) together with 31 g (0.1 amino group equivalent) of a mixture of 1-amino-eicosane and 1-aminodocosane and 50 g of butylglycol are stirred for 3 hours at 100°C internal temperature. 17.7 G of 1,6-hexanediol (0.3 hydroxyl group equivalent) and 50.5 g of sebycic acid (0.5 acid group equivalent) are then added and the mixture is again stirred for 3 hours at 100°C internal temperature. Thereafter 4.6 g of epichlorohydrin are added and the batch is again stirred for 3 hours at 100°C internal temperature. It is then diluted with 132 g of butylglycol and further stirred until cold. A clear solution of mesdium viscosity and of acid number 42.6 is obtained.

EXAMPLE 27

392 G of an epoxide according to Example 1 (2 epoxide equivalents) together with 310 g (2 amino group equivalent) of a mixture of 1-amino-eicosane and 1-amino-docosane and 200 g of dioxan are stirred for 3 hours at 100°C internal temperature. 70.8 G of 1,6-hexanediol (1.2 hydroxyl group equivalents) and 202 g of sebacic acid (2 acid group equivalents) are then added and the mixture is again stirred for 3 hours at 100°C internal temperature. 37 G of epichlorohydrin (0.4 mol) are then added and the batch is stirred for a further 3 hours at 100°C internal temperature.

Thereafter it is diluted with 812 g of dioxane and further stirred until cold. A solution of medium viscosity and of acid number 81.5 is obtained.

EXAMPLE 28 a. 98 G of an epoxide according to Example 1 (0.5 epoxide equivalent) together with 31 g (0.1 amino group equivalent) of a mixture of 1-amino eicosane and 1-aminodocosane and 50 g of butylglycol are stirred for 3 hours at 100°C internal temperature. 15.6 G of neopentyl glycol (0.3 hydroxyl group equivalent) and 50.5 g of sebacic acid (0.5 acid group equivalent) are then added and the mixture is again stirred for 3 hours at 100°C internal temperature. 9.25 g of epichlorohydrin (0.1 mol) are then added and the whole is stirred for a further 3 hours at 100°C internal temperature. Thereafter it is diluted with 154 g of trichloroethylene and further stirred until cold. A clear solution of medium viscosity and of acid number 36 is obtained.

100 G of the 50% strength product described and 10 g of a 50% strength solution of an addition product of 70 mols of ethylene oxide with a fatty amine mixture ($C_{16}$–$C_{22}$) are mixed with rapid stirring and slowly diluted with 140 g of deionised water. A mobile fine-particled emulsion of 20% strength active substance content is obtained. The pH is 5.

b. 98 G of the epoxide according to Example 1 (0.5 epoxide group equivalent) and 31 g of a mixture of 1-amino-eicosane and 1-aminodocosane (0.2 amino group equivalent = hydrogen atoms bonded to amino nitrogen) and 50 g of dimethyl formamide are stirred together for 15 minutes at 100°C internal temperature. Then 15.6 g of neopentyl glycol (0.3 hydroxyl group equivalent) are added and stirring is continued for 3 hours at 100°C internal temperature. The 13.9 g of epichlorohydrin (0.15 mol) are added and stirring is again continued for 3 hours at 100°C internal temperature. Dilution with 159 g of perchloromethylene yields a 50% product of medium viscosity with an acid number of 28.4.

100 G of the 50% product are then treated with a 50% aqueous solution of hydroabiethylamine and 80 mols of ethylene oxide and thoroughly mixed. A solution of 2 g of diammonium phosphate in 52.5 g of water (deonised) is then added slowly and the batch is emulsified for about 5 minutes. A finely dispersed, highly fluid emulsion with a resin content of 30% is obtained. The pH is 6.8.

EXAMPLE 29

98 G of an epoxide according to Example 1 (0.5 epoxide equivalent) together with 31 g (0.2 amino group equivalent) of a mixture of 1-amino-eicosane and 1-amino-docosane and 50 g of butylglycol are stirred for 3 hours at 100°C internal temperature. 17.7 G of 1,6-hexanediol (0.3 hydroxyl group equivalent) and 50.5 g of sebacic acid (0.5 acid group equivalent) are then added and the mixture is again stirred for 3 hours at 100°C internal temperature. 5.8 G of hydroxyethyl acrylate (0.05 mol) are then added and the whole is stirred for a further 3 hours at 100°C internal temeprature.

After dilution with 147.6 g of butylglycol it is furhter stirred until cold. A clear solution of medium viscosity and of acid number 66 is obtained.

EXAMPLE 30

98 G of an epoxide according to Example 1 (0.5 epoxide equivalent) together with 31 g of a mixture of 1-amino-eicosane and 1-amino-docosane (0.2 amino group equivalent) and 55.5 g of butylglycol are stirred for 3 hours at 100°C internal temperature. 17.7 G of 1,6-hexanediol (0.3 hydroxyl group equivalent) and 50.5 g of sebacic acid (0.5 acid group equivalent) are then added and the mixture is again stirred for 3 hours at 100°C internal temperature.

3.6 G of acrylic acid (0.05 mol) are then added and the batch is stirred for a further 3 hours at 100°C internal temperature. After dilution with 145.4 g of butylglycol it is further stirred until cold. A clear solution of medium viscosity and of acid number 71.5 is obtained.

EXAMPLE 31

98 G of an epoxide according to Example 1 (0.5 epoxide equivalent) together with 31 g of a mixture of 1-amino-eicosane and 1-amino-docosane (0.2 amino group equivalent) and 55.5 g of butylglycol are stirred for 3 hours at 100°C internal temperature. 17.7 G of 1,6-hexanediol (0.3 hydroxyl group equivalent) and 50.5 g of sebacic acid (0.5 acid group equivalent) are then added and the mixture is again stirred for 3 hours at 100°C internal temperature. 3.2 G of glycidyl methacrylate (0.025 mol) are then added and the whole is again stirred for 3 hours at 100°C internal temperature. After dilution with 145.4 g of butylglycol it is further stirred until cold. A clear solution of medium viscosity and of acid number 56.9 is obtained.

EXAMPLE 32

98 G of an epoxide according to Example 1 (0.5 epoxide equivalent) together with 31 g of a mixture of 1-amino-eicosane and 1-amino-docosane (0.1 amino group equivalent) and 55.5 g of butylglycol are stirred for 3 hours at 100°C internal temperature. 17.7 G of 1,6-hexanediol and 50.5 g of sebacic acid are then added and the mixture is again stirred for 3 hours at 100°C internal temperature. Thereafter 5.1 g of methylolarylamide (0.05 mol) are added and the whole is stirred for a further 3 hours at 100°C internal temperature. After addition of 146.9 g of butylglycol it is further stirred until cold.

A clear mobile solution of acid number 59 is obtained.

EXAMPLE 33

98 G of an epoxide according to Example 1 (0.5 epoxide equivalent) together with 54.2 g of a mixture of 1-aminoeicosane and 1-amino-docosane (0.35 amino group equivalent) and 60.6 g of sebacic acid (0.6 acid group equivalent) are stirred for 2 hours at 100°C internal temperature.

66.3 G of hexamethylolmelamine hexamethyl ether are then added and the mixture is again stirred for 1 hour at 100°C internal temperature. Thereafter it is diluted with 279 g of butylglycol and further stirred until cold. A product of medium viscosity and of acid number 61 is obtained.

EXAMPLE 34

98 G of an epoxide according to Example 1 (0.5 epoxide equivalent) together with 54.2 g of a mixture of 1-aminoeicosane and 1-amino-docosane (0.35 amino group equivalent) and 60.6 g of sebacic acid (0.6 acid group equivalent) are stirred for 2 hours at 100°C internal temperature. 57.5 G of hexamethylolmelamine pentamethyl ether are then added and the mixture is again stirred for 1 hour at 100°C internal temperature. It is then diluted with 264 g of butylglycol and further stirred until cold. A product of medium viscosity and of acid number 64.5 is obtained.

EXAMPLE 35

98 G of an epoxide according to Instruction 1 (0.5 epoxide equivalent) together with 54.2 g of a mixture of 1-amino-eicosane and 1-amino-docosane (0.35 amino group equivalent), 60.6 g of sebacic acid (0.6 acid group equivalent) and 50 g of butylglycol are stirred for 2 hours at 100°C internal temperature. 62.3 G of the methyl ether of dihydroxydimethylolethyleneurea are then added and the mixture is again stirred for 1 hour at 100°C internal temperature. Thereafter it is filuted with 225 g of butylglycol and further stirred until cold. A product of medium viscosity and of acid number 69.6 is obtained.

| | Composition of the alkylamine | Alkylene odide, mol | Alkylene oxide adduct, parts (1 mol) | Urea, parts | Amido-sulphonic acid, parts | Water, parts |
|---|---|---|---|---|---|---|
| 1 | 30% of hexadecylamine<br>25% of octadecylamine<br>45% of octadecenylamine | 7 | 580 | 107 | 214 | 650 |
| 2 | " | 7 | 580 | 200 | 320 | 450 |
| 3 | " | 7 | 580 | 214 | 214 | 540 |
| 4 | " | 10.5 | 773 | 107 | 214 | 840 |
| 5 | " | 16 | 1010 | 200 | 320 | 880 |
| 6 | " | 16 | 1010 | 214 | 214 | 970 |
| 7 | 10% of stearylamine<br>55% of arachidylamine<br>25% of behenylamine | 30 | 1620 | 200 | 320 | 1450 |

USE EXAMPLES

I.

100 Kg of yarn consisting of 90% wool and 10% polyamide (ε-caprolactam) are first dyed in a circulation dyeing apparatus in the conventional manner, preferably with reactive dyestuffs on account of the fastness properties. After the yarn has been dyed it is rinsed and a fresh treatment bath is prepared. The water temperature is 20°C. To this bath are then added:

3000 g of $KHSO_5$ 1000 g of a 50% aqueous solution of the reaction product 6 according to Example 36
2000 g of 80% acetic acid, and
12000 g of the aqueous preparation according to

EXAMPLE 2

An emulsion is formed in the treatment liquor, which is then pumped through the material in alternating direction. The liquor is allowed to circulate for 40 minutes, during which time the emulsion is absorbed completely on the fibres and the treatment bath becomes clear as water. Then there are added to the liquor:

3000 g of sodium bisulphite and
3000 g of a solution of 74.2 g of polyethylene (contains partially oxidised carboxyl groups), 22.8 g of paraffin (melting point: 60° to 62°C), 17.1 g of a condensation product of dimerised unsaturated fatty acids and diethylene triamine, and 152 g of butyl glycol.

Treatment is carried out for 30 minutes at the same temperature. The material is then rinsed and dried at 80°C.

A piece of knotted fabric is manufactured from this yarn and tested according to IWS Specification 72. The following values are obtained:

| Material | Relaxation | Shrimkage |
|---|---|---|
| untreated | 7 % | 52 % |
| treated | 0,1 % | 2,4 % |

Instead of the above cited blend of wool/polyamide it is also possible both to use other mixing ratios and to blend other fibres with the wool, e.g. polyester, polyacrylonitrile, or cellulosic fibres, or it is also possible to finish pure wool.

II.

100 Kg of wool yarn, which have already been dyed as top, are wetted at 30°C in a vertical Muff dyeing apparatus. After about 10 minutes there are added to the treatment bath 5000 g of $KHSO_5$
500 g of a 50% aqueous solution of the reaction product 6
2000 g of 80% acetic acid
14000 g of the aqueous preparation according to Example 5.

A milky emulsion forms in the bath and is completely absorbed on the wool over the course of 30 minutes. The treatment bath is then heated to 60°C and 4000 g of sodium bisulphite and 2000 g of a polyethylene/paraffin solution as described in Example I are added.

The treatment bath is drawn off after a treatment time of 20 minutes, the yarn is centrifuged and dried at 60°–80°C. A knitted fabric prepared from this yarn corresponds to IWS Specification 72 (4%shrinkage).

III.

a. 100 Kg of wool yarn is first dyed in the conventional manner, e.g. with a reactive dyestuff. The yarn is then rinsed and a fresh treatment bath of 2000 litres of water and a temperature of 30°C is prepared. To this bath are then added 4000 g of the acid potassium salt of monopersulphuric acid and the liquor is allowed to circulate for a few minutes. Then are added 500 g of a 50% aqueous solution of the reaction product 6 and 5000 g of 80% acetic acid. After a brief dwell there are then added 8000 g of the aqueous preparation according to Example 28 (*a*).

An emulsion forms in the treatment bath and is completely absorbed on the wool over the course of 40 minutes. The bath is then heated to 60°C in 10 minutes and 2000 g of sodium bisulphite and 2000 g of an aqueous emulsion of polyethylene (contains partially oxidised carboxyl groups) are added. After a further 15 minutes at 60°C the treatment bath is drawn off, the wool centrifuged and dried at 80°C.

The finished wool is processed to a knitted fabric and tested for the non-felting effect. According to IWS Specification 72 there is a shrinkage of 3–5%. Similarly good results are also obtained with the reaction products 1 to 5 and 7, as well as with the reaction products of Examples 1 to 27 and 29 to 35 (component 2).

b. Instead of the described aftertreatment with the polyethylene emulsion it is also possible to add 2000 g of a 20% aqueous emulsion of the following composition to the treatment bath or to apply it in an aftertreatment. The yarn display a very good non-felting effect. Manufacture of the emulsion:

315.76 G of deonised water, 12.3 g of glacial acetic acid, 6.1 g of a condensation product of 1 mol of actadecyl alcohol and 35 moles of ethylene oxide and 0.1 g of antifoaming agent are heated to 95°C internal temperature in a heatable agitator flask. Then, while stirring thoroughly, a solution of 74.2 g of polyethylene (contains partially oxidised carboxyl groups), 22.8 g of paraffin (melting point: 60°–62°C), 17.1 g of a condensation product of dimerised unsaturated fatty acids and diethylene triamine, and 152 g of butyl glycol is added. The temperature of the solution is about 110°C. The resulting emulsion is subsequently slowly cooled. To this emulsion can subsequently be added a silicone oil emulsion, in which case about 5% to 15%, based on the solids content of the emulsion, is used.

IV.

A treatment bath is prepared in a yarn dyeing apparatus with 3000 litres of water of 30°C and the following additives are given to it:

4000 g of $KHSO_5$
1000 g of a 50% aqueous solution of the reaction product 6 according to Example 36
2000 g of 80% acetic acid
7000 g of the aqueous preparation according to Example 28.

100 Kg of dyed wool yarn are put into this bath and the treatment liquor is allowed to circulate in alternating direction. The emulsion present in the bath absorbs completely and uniformly on the wool yarn in 30 to 40 minutes. The bath is then heated to 60°C and 2000 g of sodium bisulphite and 2000 g of the emulsion according to III (*b*) are added thereto. After a further 15 minutes at 60°C the yarn is centrifuged and thoroughly dried at 80°C. Before being centrifiged the yarn can also be rinsed with cold water.

A knitted fabric is made from the dry yarn and it is tested in a Cubex according to IWS Speicifcation 72. The shrinkage of the yarn is about 3%. Untreated yarn has a shrinkage of about 60%.

V.

100 Kg of pure wool double knit are first wetted out in 1000 litres of water of 40°C in a beam dyeing apparatus. There are then added 2000 g of $KHSO_5$
3000 g of 80% acetic acid
600 g of a 50% aqueous solution of the reaction product 6
6000 g of the aqueous preparation according to Example 16.

The emulsion present in the bath is absorbed completely on the wool over the course of 30 minutes. There are then added 3000 g of sodium bisulphite and 2000 g of a polyethylene/paraffin solution as described in Example 1.

The liquor is heated slowly to 60°C and treated for 15 minutes at this temperature. The knitted fabric is subsequently rinsed and dried on a stenter (2 minutes at 120°C). The finished double knit corresponds to IWS Specification 72 (3% shrinkage).

VI.

100 Kg of knitting wool Nm 28/2/24 in the form of cheeses are first dyed in the conventional manner and then provided with a non-felting finish in a fresh treatment bath of 40°C as described hereinbelow. To the treatment bath are added:

4000 g of $KHSO_5$
1000 g of a 50% aqueous solution of the reaction product 6 according to Example 36
4000 g of 80% acetic acid
6000 g of the aqueous preparation according to Example 18.

Treatment is carried out for 40 minutes and then 3000 g of sodium bisulphite and 3000 g of polyethylene paraffin solution as described in Example I are added to the treatment bath. Treatment is carried for 10 minutes, the bath is drawn off, and the wool is dried for 2 hours at 60°C. The treated yarn corresponds to IWS Specification 72. Similar results are obtained also by using the aqueous preparation according to Example 20.

We claim:

1. A process for rendering wool non-felting, wherein the wool is treated at 20° to 100°C with an aqueous preparation which contains 1. an alkali metal, ammonium or amine acid salt of monopersulphuric acid,
2. a reaction product of epoxides containing at least two epoxide groups per molecule, fatty amines and dicarboxylic acids, the equivalent ratios of epoxide groups to hydrogen bonded to amino nitrogen to carboxylic acid groups being 1:(0.1–1):(1–0.55),
3. an adduct of primary monoamines with 12 to 22 carbon atoms and 6 to 30 moles of ethylene oxide, which is esterified with an at least dibasic oxygen containing acid, and, optionally
4. an agent that imparts a soft handle, and is subsequently subjected to a reductive aftertreatment.

2. A process according to claim 1 wherein as component (1) there is used a sodium, potassium or ammonium acid salt of monopersulphuric acid.

3. A process according to claim 1, wherein the aqueous preparation contains, as component (2), reaction products of epoxides, fatty amines and dicarboxylic acids which are obtained by reaction, in the presence of an organic solvent, of at least (*a*) an epoxide which contains at least two epoxide groups per molecule, (*b*) a fatty amine with 12 to 24 carbon atoms, and ($c_1$) an aliphatic, saturated dicarboxylic acid with at least 7 carbon atoms and optionally ($c_2$) an anhydride of an aromatic dicarboxylic acid with at least 8 carbon atoms or of an aliphatic monocarboxylic acid with at least 2 carbon atoms or of a dicarboxylic acid with at least 4 carbon atoms, and optionally one or more of the following components: (*d*) an aminoplast precondensate containing alkylether groups, (*e*) an aliphatic diol with 2 to 22 carbon atoms and (*f*) a polyfunctional, preferably difunctional, organic compound which contains, as functional groups or atoms, mobile halogen, vinyl or ester groups or at most one acid, nitrile, hydroxyl or epoxide group together with at least one other functional group or an atom of the indicated type, and which are thereafter optionally treated, optionally at elevated temperature, with (*g*) ammonia or a water-soluble organic base.

4. A process according to claim 3, wherein the aqueous preparations contain as component (2) reaction products of epoxides, fatty amines, and dicarboxylic acids, which are obtained by reaction together in the presence of an organic solvent, at least (*a*) an epoxide derived from a bisphenol, (*b*) a fatty amine wth 12 to 24 carbon atoms, (*c*) an aliphatic, saturated dicarboxylic acid with 7 to 14 carbon atoms and optionally one or more of the following components:

d. an aminoplast precondensate containing alkyl ether groups
e. an aliphatic diol with 2 to 6 carbon atoms, and
d. an epihalohydrin.

5. A process according to claim 3, wherein the component (*a*) is an epoxide which is derived from a bisphenol.

6. A process according to claim 5, wherein the component (*a*) is a polyglycidyl ether of 2,2-bis-(4′-hydroxyphenyl)-propane.

7. A process according to claim 6, wherein the component (*a*) has an epoxide content of at least 5 epoxide group equivalent per kilogram.

8. A process according to claim 6, wherein the component (*a*) is a reaction product of epichlorohydrin with 2,2-bis-(4′-hydroxyphenyl)-propane.

9. A process according to claim 3, wherein the component ($c_1$) is a dicarboxylic acid of the formula ps $$HOOC - (CH_2)_y - COOH$$

wherein *y* is a whole number from 5 to 12.

10. A process according to claim 3, wherein the component ($c_2$) is an anhydride of a mono- or bicyclic aromatic dicarboxylic acid with 8 to 12 carbon atoms or of a monocarboxylic acid with at least 2 carbon atoms.

11. A process according to claim 3, wherein the component (*d*) is an alkyl ether of a methylolaminotriazine.

12. A process according to claim 11, wherein the component (*d*) is an alkyl ether of a highly methylolated melamine whose alkyl radicals contain from 1 to 4 carbon atoms.

13. A process according to claim 12, wherein the component (*d*) consists of n-butyl ethers of a highyl methylolated melamine which contain 2 to 2 n-butyl radicals in the molecule.

14. A process according to claim 3, wherein the component (*e*) is an aliphatic diol with 2 to 6 carbon atoms and whose the carbon chains are optionally interrupted by oxygen atoms.

15. A process according to claim 3, wherein the component (*f*) is a difunctional organic compound which contains, as functional groups or atoms, halogen atoms bonded to an alkyl radical, vinyl or carboxylic acid ester groups or at most one epoxide, carboxylic acid or hydroxyl group together with another functional group and another atom of the indicated type.

16. A process according to claim 3, wherein the component (*f*) is an epihalogenohydrin.

17. A process according to claim 3, wherein the component (*g*) is an aliphatic tertiary monoamine, ammonia or an amine containing at least two amino groups and exclusively basic nitrogen atoms, with the amino groups each possessing at least one hydrogen atom bonded to nitrogen.

18. A process according to claim 3, wherein the component (*g*) is an aliphatic polyamide of the formula $$H_2N - (CH_2-CH_2-NH)_n - CH_2 - CH_2 - NH_2$$

wherein *n* is 1, 2 or 3.

19. A process according to claim 3, wherein the reaction of the component (*a*) with the component (*b*) is carried out at 20° to 120°C.

20. A process according to claim 1, wherein the component (3) consists of adducts of fatty amines with 12 to 22 carbon atoms and 6 to 30 mols of ethylene oxide, esterified with sulphuric acid.

21. A process according to claim 20, wherein the adducts contain 7 to 16 mols of ethylene oxide.

22. A process according to claim 20, wherein the component (3) consists of alkali metal salts of ammonium salts of the esterified adducts.

23. A process according to claim 1, wherein as component (4) an agent for imparting a soft handle is applied to the wool simultaneously with the aqueous preparations of the agent for imparting nonfelting properties, or is applied in the form of an after-treatment.

24. Process according to claim 23, wherein oil, fat and wax emulsions, fatty acid condensation products or polyethylene, siloxane and silicone emulsions or their mixtures are used as agents for imparting a soft handle.

25. A process according to claim 1, wherein as reducing agents there are used sulphides, hydrogen sulphides, hydroxylamines, thiosulphates, sulphites and hydrogen sulphites of alkali metal and alkaline earth metals, as well as of ammonium.

26. The wool material, or fibre material containing wool, which is finished according to the process claimed in claim 1.

* * * * *

UNITED STATES PATENT AND TRADEMARK OFFICE

CERTIFICATE OF CORRECTION

PATENT NO. : 3,944,385

DATED : March 16, 1976

INVENTOR(S) : Hans Hostettler et al.

It is certified that error appears in the above-identified patent and that said Letters Patent are hereby corrected as shown below:

Column 22, line 43, claim 9, delete "ps" after the word formula;

Column 22, line 58, claim 13, delete "highyl" and substitute -- highly --.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*